US005529661A

United States Patent [19]

Backlund

[11] Patent Number: 5,529,661

[45] Date of Patent: Jun. 25, 1996

[54] PROCESS FOR CONTROLLING THE FLOW OF CELLULOSIC FIBER MATERIAL THROUGH AN IMPREGNATION VESSEL

[75] Inventor: Åke Backlund, Karlstad, Sweden

[73] Assignee: Kvaerner Pulping Technologies AB, Karlstad, Sweden

[21] Appl. No.: 403,139

[22] Filed: Mar. 13, 1995

Related U.S. Application Data

[63] Continuation of Ser. No. 39,095, Apr. 7, 1993, abandoned which is a continuation of PCT/SE92/00546, Aug. 11, 1992, published as WO93/04232, Mar. 4, 1993.

[30] Foreign Application Priority Data

Aug. 23, 1991 [SE] Sweden ..... 91024273

[51] Int. Cl.[6] ..... D21C 7/14

[52] U.S. Cl. ..... 162/41; 162/42; 162/59; 162/248

[58] Field of Search ..... 162/19, 41, 42, 162/59, 86, 248, 249

[56] References Cited

U.S. PATENT DOCUMENTS

| | | | |
|---|---|---|---|
| 3,303,088 | 2/1967 | Gessner | 162/41 |
| 3,802,956 | 4/1974 | Backlund | 162/19 |
| 5,080,755 | 1/1992 | Backlund | 162/19 |
| 5,203,963 | 4/1993 | Henricson | 162/19 |

FOREIGN PATENT DOCUMENTS 2640651 6/1990 France .

OTHER PUBLICATIONS

Johansson, Birgitta, "Modified cont. kraft–now a reality", Oct. 1984, Svensk papperstidning, pp. 30–35.

Norden Solveig, "Modified kraft . . . pulp", Jul. 1979, TAPPI, vol. 62, No. 7, pp. 49–51.

Kleppe, P., "Polysulfide AQ Pulping . . . ", Pulp & Paper, Jun. 1988, pp. 49–53.

*Primary Examiner*—David L. Lacey
*Assistant Examiner*—Dean T. Nguyen
*Attorney, Agent, or Firm*—Cushman Darby & Cushman

[57] ABSTRACT

A process for the continuous digestion of cellulosic fiber material, comprising impregnation with impregnating liquid consisting of at least one fresh digesting liquor, in a closed impregnating system and subsequent digestion with digesting liquid in a closed digester system, said impregnating liquid being supplied through a supply system, together with steamed fibre material, to an inlet end of the impregnating system, liquid being withdrawn from the impregnating system at a point (46) located at a predetermined distance from said inlet end. According to the invention such a first quantity of liquid (F) is withdrawn at said withdrawal point (46) and recirculated directly to the supply system that a predetermined minimum ratio between liquid and fibre material is continuously maintained in the impregnating system prior to said withdrawal point (46), the liquid in said liquid to fibre material ratio being derived from original moisture (A) in the fibre material, condensates (B, C) from an initial steaming of the fibre material, and added fresh digesting liquor(s) (D and/or E) besides said withdrawn and recirculated quantity of liquid (F).

10 Claims, 1 Drawing Sheet

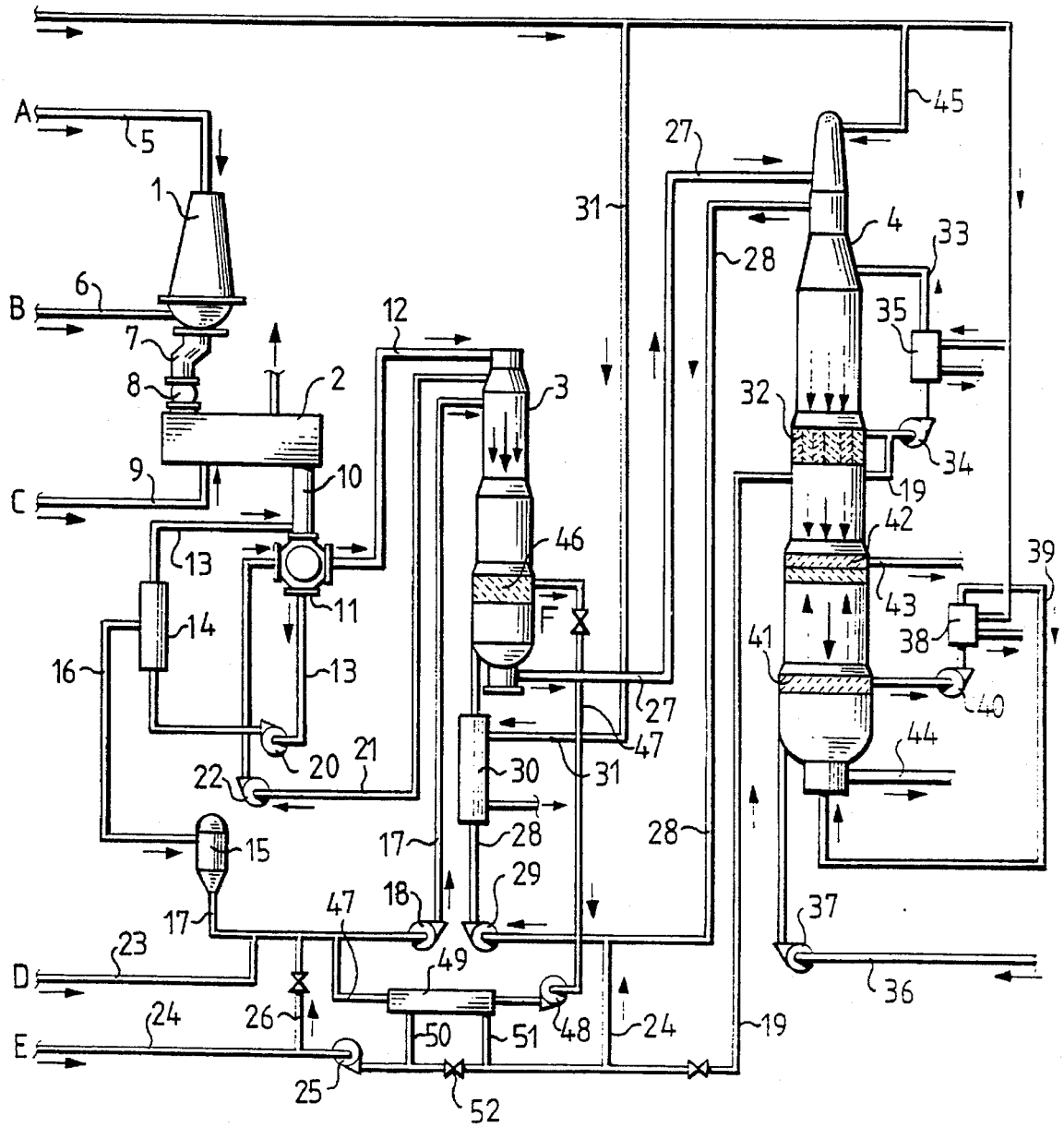
A
B
C
D
E
F
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52

PROCESS FOR CONTROLLING THE FLOW OF CELLULOSIC FIBER MATERIAL THROUGH AN IMPREGNATION VESSEL

This is a continuation of application Ser. No. 08/039,095, filed on Apr. 7, 1993, which was abandoned upon the filing hereof, which is a continuation of PCT/SE92/00546, filed Aug. 11, 1992 and published as WO93/04232 on Mar. 4, 1993.

FIELD OF THE INVENTION

The present invention relates to a process for the continuous digestion of cellulosic fiber material, comprising impregnation with impregnating liquid consisting of at least one fresh digesting liquor, in a closed impregnating system and subsequent digestion with digesting liquid in a closed digester system, said impregnating liquid being added through a supply system, together with steamed fibre material, to an inlet end of the impregnating system, liquid being withdrawn from the impregnating system at a point located at a predetermined distance from said inlet end.

BACKGROUND OF THE INVENTION

When feeding wood chips, for instance, into a continuous digester a certain minimum quantity of liquid must be added through the supply system together with the chips. If too little liquid is added in relation to the quantity of chips the temperature will become too high in the supply system and the sinking rate of the chips in the impregnating vessel or digester will be disturbed. The requisite amount of liquid is normally obtained with the digesting liquor, e.g. white liquor, added to the supply system for impregnating the chips. If necessary spent digesting liquid (black liquor), the temperature of which has been lowered through relief in several steps or by means of indirect cooling, may be returned to the supply system, thus increasing the amount of liquid available. In certain multi-step processes in which the first step is impregnation or digestion with a different chemical from that used in subsequent digestion step or where for technical reasons it is unsuitable to use fully spent digesting liquid (black liquor), the requirement for a certain minimum quantity of liquid must be fulfilled by adding a sufficient amount of the digesting liquid from the first step, possibly diluted with water. This entails several drawbacks such as poorer heat economy due to the increased consumption of steam in subsequent cooking steps and/or increased need for evaporation for recovery of the chemicals. Another drawback may be that the concentration of the cooking chemicals in first step becomes too low to achieve the desired effect of the process. Addition of black liquor to the supply system is described in Se 359 331 and U.S. Pat. No. 5,080,755. In the processes according to said documents liquid is withdrawn from the impregnation system at a point located at a predetermined distance from the inlet end, and the liquid withdrawn is mixed with black liquor.

The liquid to wood ratio at the inlet to a continuous digester is normally 3.0–3.5 $m^3$ per ton dry chips. In conventional sulphate cooking 70–100% of the white liquor required is normally added to the supply system for the impregnating vessel via a high-pressure pump. The amount of liquid at the inlet to the impregnating vessel may then be within an interval of about 2.4–2.8 $m^3$ per ton dry chips, distributed as follows:

| | | |
|---|---|---|
| A | Chips moisture (moisture content 50%) | 1.0 $m^3$ |
| B + C | Steam condensate | 0.3 $m^3$ |
| E | White liquor (70–100%) | 1.1–1.5 $m^3$ |

As mentioned above, black liquor can be added to the impregnating vessel through the supply system in order to increase the liquid to wood ratio, for instance to 3.0 $m^3$ or above. The temperature of the black liquor should not exceed 100° C. If too little liquid is added to the impregnating vessel, disturbances will result in the supply system due to the formation of steam in the down pipe located before the high pressure valve. The temperature of the liquid exceeds the temperature corresponding to the steam pressure in the pressure steaming vessel located upstream. Sinking of the chips in the impregnating vessel is also impeded. The quantity of free liquid, i.e. the portion of liquid which is not absorbed by the chips, becomes too low and the flow rate of the liquid is correspondingly reduced. The flow rate of the free liquid exerts a driving force on the column of chips. It is important that this driving force is great in the upper part of the impregnating vessel where the chips are still not saturated with liquid but have a tendency to float. This requirement is of less importance in the lower part of the impregnating vessel since by this stage the chips are substantially saturated with liquid and therefore tend to sink due to their own weight. When treatment is carried out in several steps using different digesting liquids in the various steps, there is the same need to maintain a sufficiently high liquid to wood ratio in the first step, i.e. in the initial concurrent flow zone in the impregnating vessel. However, it may be that the process or operating economy requires that the digesting liquid of the first step has to be added in a limited quantity, in which case it may be difficult to achieve a sufficiently high liquid to wood ratio. At the same time, the liquid flow at the entrance to the digester must be controlled so that it does not become too great since this results in too great a consumption of high-pressure steam in heat exchanger present in the transfer system and of direct steam to the top of the digester. Furthermore, the withdrawal strainer in the upper part of the countercurrent flow washing zone of the digester becomes overloaded.

SUMMARY OF THE INVENTION

The object of the present invention is to eliminate said problems and provide a simple and reliable method of maintaining a sufficiently high flow of liquid in at least the initial part of the impregnating vessel without the liquid flow in the digester becoming too high. In other words, the invention aims to solve the problems existing when black liquor cannot be used in order to provide a sufficiently high liquid to wood ratio in the impregnating vessel without such ratio being too high in the digester.

The process according to the invention is characterised in that such a first quantity of liquid (F) is, withdrawn at said withdrawal point and recirculated directly to the supply system so that a predetermined minimum ratio between liquid and fibre material is continuously maintained in the impregnating system prior to said withdrawal point, the liquid in said liquid to fibre material ratio being derived from original moisture (A) in the fibre material, condensates (B, C) from an initial steaming of the fibre material, and added fresh digesting liquor(s) (D and/or E) besides said withdrawn and recirculated quantity of liquid (F). The term "directly" as used herein means that the liquid is recirculated as such to the supply system, i.e. without being mixed with black liquor.

BRIEF DESCRIPTION OF THE DRAWING

FIG. 1 shows schematically a flow diagram of a plant for the continuous digesting of cellulosic fiber material in the form of wood material which has been disintegrated to chips.

DETAILED DESCRIPTION OF THE INVENTION

The plant shown in FIG. 1 comprises a vertical steaming vessel 1, a horizontal steaming vessel 2, a vertical impregnating vessel 3 and a vertical digester 4. Chips are fed through a pipe 5 to the vertical steaming vessel 1, to which low pressure steam is supplied through a pipe 6 in order to heat the chips and reduce their air content. This pre-steaming process is performed at atmospheric pressure. The heated chips are dosed by a chip meter disposed in a connection 7 between the two steaming vessels, said connection 7 also containing a lower-pressure valve 8 which locks through the chips into the horizontal steaming vessel 2. Low-pressure steam is added through a pipe 9. The pressure in this second steam vessel 2 is 1–1.5 bar over-pressure. From the pressure steaming vessel 2, the chips fall into a down pipe 10 with a high pressure valve 11 disposed at the lower end thereof. A liquid level is maintained in the down pipe 10. The high pressure valve 11 is provided with a rotor having pockets. One pocket is always in low pressure position to be in open communication with the pre-steaming vessel 1, and another pocket is always simultaneously in high pressure position to be in open communication with the impregnating vessel 3 via a supply pipe 12 connected to the top of the impregnating vessel 3. Liquid in a circulation loop 13 provided with a pump 20 feeds the chips from the down pipe 10 into the high pressure valve 11 and fills one of the rotor pockets. A screen is mounted in the housing of the high pressure valve 11 to prevent chips from accompanying the circulation liquid in the circulation loop 13. The liquid displaced by the chips in the high pressure valve 11 is withdrawn from the circulation loop 13 by means of a screen 14 disposed therein, from which the liquid withdrawn is conducted to a level tank 15 via a pipe 16. The level tank 15 is connected to the top of the impregnating vessel 3 by a pipe 17 containing a high-pressure pump 18 to pump the liquid withdrawn into the impregnating vessel 3.

The high pressure valve 11 and impregnating vessel 3 are connected by means of a calculation loop comprising said supply pipe 12 which is connected to the top of the impregnating vessel 3, and a return pipe 21 which connects the top of the impregnating vessel to the high pressure valve 11 to return liquid separated off by a top separator disposed in the impregnating vessel 3. The liquid is caused to circulate by means of a pump 22 located in the return pipe 21. When a filled rotor pocket arrives in the high pressure position, i.e. in direct communication with the circulation loop 12, 21, it is rinsed clean by the return liquid in this circulation loop. The flow rate of the return liquid is so high that it flushes the chips from the rotor pocket with it into the impregnating vessel 3. The pressure in the impregnating vessel 3 is normally 8–15 bar over-pressure. However, for certain processes it may be as high as 15–45 bar over-pressure.

Fresh digesting liquor D from a first storage tank is fed to the top of the impregnating vessel 3 via a pipe 23. The pipe 23 is suitably connected to the pipe 17 from the level tank 15 so that the high-pressure pump 18 is utilized for pumping both the liquid withdrawn from the first circulation loop 13, and the digesting liquor D which thus constitutes fresh impregnating liquid.

Fresh digesting liquor E is fed to the digester from a second storage tank via a pipe 24 containing a high-pressure pump 25. Some of the digesting liquor E may be used as impregnating liquid and be fed to the top of the impregnating vessel 3 via a branch pipe 26 provided with a valve. This branch pipe 26 is suitably connected to the pipe 17 from the level tank 15. The impregnated chips are transferred from the bottom of the impregnating vessel 3 to the top of the digester 4 via a pipe 27. A strainer is mounted at the top of the digester 4 to separate off a certain amount of liquid which is then returned to the bottom of the impregnating vessel 3 via a return pipe 28 containing a pump 29 to pump the chips to the digester 4 with the aid of the separated liquid. The return pipe 28 passes a heat exchanger 30 to heat the liquid passing it by the supply of high-pressure steam via a pipe 31. The supply pipe 27 and return pipe 28 form a transfer circulation for the suspension of impregnated chips and boiling liquid. A larger quantity of digesting liquor E is added to said transfer circulation in that the pipe 24 for the digesting liquor is connected to the return pipe 28 before pump 29. If desired, a smaller quantity of the digesting liquor may be added to a circulation pipe 33 of the digester, via a pipe 19 provided with a valve. The digester is provided with a strainer 32 for circulation of liquid through pipe 33 with the aid of a pump 34, the liquid being heated in a heat exchanger 35. The pipe 33 comprises a central tube disposed in the centre of the digester with its orifice at the strainer 32. The digested chips are washed in countercurrent flow in the lower part of the digester, using washing liquid supplied through a pipe 36 and pumped by a high-pressure pump 37 into the lower part of the digester in an amount which is regulated to ensure that the digester is kept filled with liquid. The washing liquid is heated indirectly by steam which is supplied to a heat exchanger 38 disposed in a pipe 39 for circulation of washing liquid by means of a pump 40. The washing liquid is removed through a strainer 41 and returned through a central pipe extending from the bottom of the digester and having its orifice at a strainer 41. The washing liquid heated in this manner is forced to flow in countercurrent up through the chips column as it moves slowly downwards, thereby displacing its content of spent digesting liquor which is withdrawn through a strainer 42 and conducted via a pipe 43 to a flash cyclone (not shown) and a recovery plant (not shown). The digested chips are fed out at the bottom of the digester using suitable scrapers, and is conducted through a pipe 44 for continued processing. Besides indirect heating of digesting liquid and wood in said transfer circulation 27, 28, indirect heating is also performed with steam supplied to the top of the digester through a pipe 45.

According to the present invention the impregnating vessel is provided with a strainer 46 disposed at a predetermined distance from the top of the impregnating vessel as seen from the point where the chips are supplied, i.e. the inlet end. According to the present invention, furthermore, a return pipe 47 provided with a valve is connected between this strainer 46 and the top of the impregnating vessel in order to return a predetermined quantity of liquid to the start of the impregnating zone. The return pipe 47 contains a high-pressure pump 48 and passes through a heat exchanger 49, the other fluid side of which is connected to the pipe 24 for fresh digesting liquor E via branch pipes 50, 51. The flow to the heat exchanger 49 is regulated by a valve 52 in the pipe 24 for fresh digesting liquor E. The return pipe 47 is connected to the pipe 17 from the level tank 15 at a point located before the high-pressure pump 18.

The following example further illustrates the invention.

The impregnating liquid D is added in an amount of about 0.7 $m^3$ per ton dry wood. The quantity of liquid A from chips moisture is about 1.0 $m^3$ and from the steam condensates B and C about 0.3 $m^3$ per ton dry wood. These three sources of liquid thus supply about 2.0 $m^3$ per ton dry wood to the top of the impregnating vessel 3. Liquid F is withdrawn from the strainer 46 in the impregnating vessel in an amount of about 1.0 $m^3$ per ton dry wood. The liquid F withdrawn is cooled to a suitable temperature in the cooler 49 in order to avoid disturbances in the supply system. The total amount of the liquids A, B, C, D and F is thus about 3.0 $m^3$ per ton dry wood. This quantity of liquid is sufficient to provide a constant downward movement of the chips column in the impregnating vessel 3. The amount of liquid F may be varied within wide limits, depending on the other liquid flows to the impregnating vessel and on other operating conditions. Digesting liquor E in the form of white liquor is supplied to the digester 4 via pipes 24, 28, 27 and 19 in an amount of about 1.5 $m^3$ per ton dry chips. All together about 3.5 $m^3$ liquid per ton dry chips is thus transferred to the digester, i.e. the sum of the liquid quantities A, B, C, D and E. This gives an acceptable flow of liquid in the digester 4 with respect to heat economy and operating reliability.

When the process is repeated without withdrawing and returning liquid F (the valve in pipe 47 is closed), the amount of fresh digesting liquor D must be increased from 0.7 to 1.7 $m^3$ per ton dry chips, thus giving a total flow of liquid to the digester of 4.5 $m^3$ per ton dry chips. However, such a run is unsuitable in practice since the large flow of liquid causes too high a consumption of high-pressure steam in the heat exchanger 30 in the transfer system and of direct steam to the top of the digester. The strainer in the upper part of the countercurrent flow washing zone of the digester also becomes overloaded.

The temperature at the top of the impregnating vessel is generally about 110°–120° C. and at the bottom, i.e. in the transfer circulation pipes 27, 28, about 130°–160° C. The liquid withdrawn through the strainer 46 has a temperature of about 120°–130° C., while the black liquor withdrawn from the digester through the strainer 42 has a temperature of about 150°–170° C.

The method according to the invention for maintaining a sufficiently high flow of liquid in the upper part of the impregnating vessel can be utilized for various embodiments of the digesting process. The fresh digesting liquor D, for instance, may consist of an alkaline solution with a high sodium sulphide content or of only sodium sulphide. Sodium sulphide is consumed to a relatively small extent during impregnation conditions and a sufficiently high sodium sulphide content can therefore be maintained even if impregnating liquid F is withdrawn and returned to the inlet of the impregnating vessel. The fresh digesting liquor E may consist of ordinary white liquor, i.e. a mixture of substantially sodium sulphide and sodium hydroxide, or a white liquor containing substantially sodium hydroxide.

In the case the chips are impregnated with a part of the fresh digesting liquor E and no other fresh digesting liquor D is added, a-sufficient flow of liquid will be obtained at the beginning of the impregnating vessel by withdrawing a sufficient quantity of liquid F from the impregnating vessel 3 and returning it via the supply system. The fresh digesting liquor E required for the rest of the process is added to the digester 4 via the transfer circulation pipes 27, 28 and/or the circulation pipe 33 described or some other circulation of digesting liquid in the digester vessel.

The liquid F withdrawn from the initial concurrent flow impregnating zone may be large enough to correspond to all the free liquid. The liquid bound by the chips is about 1.8 $m^3$ per ton dry wood in the case of softwood and about 1.0–1.5 $m^3$ per ton dry wood in the case of hardwood, depending on the density of the chips. Withdrawing additional liquid through strainer 46 will cause liquid to flow upwardly from the bottom of the impregnating vessel towards the strainer 46. In such an operation some of the digesting liquor E which has been added to the transfer circulation will meet the chips in countercurrent flow, thereby resulting in improved impregnation. The additional liquid withdrawn from the lower countercurrent flow impregnating zone via the strainer 46 can be returned to the transfer circulation pipes 27, 28 or be used in some other way. It is thus not included when calculating the amount of liquid F which is withdrawn and returned to the supply system.

Circulating a considerable proportion of the impregnating liquid back to the supply system increases the concentration of the fresh digesting liquor D when this is used, thus producing improved impregnating results, particularly when the fresh digesting liquor D consists of a polysulphide solution or a solution containing anthraquinone. As mentioned earlier, the temperature in the impregnating vessel 3 can advantageously be regulated to a suitable level by cooling the withdrawn impregnating liquid F in the cooler 49.

The fresh digesting liquor D may also consist of an organic substance, such as methanol or ethanol, to impregnate-the steamed chips, possibly in the presence of a small quantity of fresh digesting liquor E, e.g. white liquor. The rest of the fresh digesting liquor E is then added to the transfer circulation 27, 28 and/or one of the liquid circulations, e.g. 33, of the digester.

The process according to the invention is also applicable to sulphite digestion in several steps, for instance acid sulphite digestion. Neither is it limited to a continuous digester with separate impregnating vessel, but may be used in a digestion vessel for the continuous digesting with initial impregnating zone, such as a one-vessel hydraulic digester.

The impregnating liquid F withdrawn may alternatively be returned to the supply system at a point in the pipe 17 located after the high-pressure pump 18. This reduces the need of pump energy.

If the liquid F withdrawn is enriched with gas, which may cause operating disturbance, it may be suitable to flash the liquid to a low pressure for degassing before feeding it to the supply system.

As will be understood from the above description and following claims no black liquor is added to the supply system of the impregnating system.

I claim:

1. In a process for the continuous digestion of cellulosic fiber material with an impregnation system including a closed vessel having a top, a bottom, an inlet, and an outlet, a liquor supply system upstream of the inlet to the impregnation vessel, and a digester system including a closed digestion vessel having an inlet and outlet, the improvement which effects the control of flow of the material through the impregnation vessel and digester comprising the steps of:

(a) supplying an impregnation liquid consisting essentially of a digesting liquid from a supply system to the inlet of the impregnation vessel together with steamed fiber material for impregnating of the liquid into the fiber material;

(b) withdrawing the impregnated material from the impregnation vessel through a first outlet, wherein the first outlet being located adjacent said bottom, said vessel having a second outlet located intermediate said top and bottom of the impregnation vessel; and (c) withdrawing a first quantity of the liquid from the impregnation vessel through said second outlet with the first quantity of the liquid being recirculated directly to the supply system, and said first quantity of the liquid being of a magnitude such that a selected ratio between the liquid and fiber material of at least 2.5 $m^3$ per ton of dry wood is continuously maintained in the impregnation vessel prior to the withdrawal of the first quantity of the liquid, wherein the liquid includes liquid derived from the original moisture content of the fiber material, condensate from the steaming of the fiber material and fresh digesting liquid together with the withdrawn and recirculated liquid.

2. The process of claim 1 wherein the ratio between the liquid and fiber material is at least 3.0:1.

3. The process of claim 1 which includes the step of using said digesting liquid in the supply system for the impregnation vessel and in the digesting system.

4. The process of claim 1 which includes the step of using a different chemical composition for the digesting liquid in the supply system for the impregnation vessel as in the digesting system.

5. The process of claim 4 which further includes the step of supplying fresh digesting liquid to the digesting system and adding a portion the fresh digesting liquid to the supply system.

6. The process of claim 5 which further includes the step of adding one of a neutral and alkaline solution of sodium sulphide, a solution of an organic compound, a solution of polysulphide and a solution of anthraquinone as the digesting liquid.

7. The process of claim 4 which further includes the step of adding one of a neutral and alkaline solution of sodium sulphide, a solution of an organic compound, a solution of polysulphide and a solution of anthraquinone as the digesting liquid.

8. The process of claim 1 which further includes the step of maintaining the temperature of the liquid and fiber material in the impregnation vessel by causing the first quantity of liquid withdrawn from the impregnation vessel to be circulated through a heat exchanger before being passed to the supply system.

9. The process as claimed in claim 1, wherein said digesting liquid is a fresh digesting liquid.

10. The process as claimed in claim 1 further including adding another fresh digesting liquid having a chemical composition different from that of said digesting liquid to said supply system.

* * * * *